US007300111B2

(12) United States Patent
Huang

(10) Patent No.: US 7,300,111 B2
(45) Date of Patent: Nov. 27, 2007

(54) BREAK-DOWN SOFA HAVING A DETACHABLE FRAME

(75) Inventor: Ben Huang, Guangdong (CN)

(73) Assignee: True Seating Concepts, LLC, Mauritius ( * ) Notice: Subject to any disclaimer, the term of this patent is extended or adjusted under 35 U.S.C. 154(b) by 8 days.

(21) Appl. No.: 11/182,958

(22) Filed: Jul. 19, 2005

(65) Prior Publication Data

US 2007/0029859 A1 Feb. 8, 2007

(51) Int. Cl.
*A47C 7/00* (2006.01)

(52) U.S. Cl. ..... 297/440.16; 297/440.14; 297/440.15; 297/440.2; 297/440.21; 297/440.23

(58) Field of Classification Search ..... 297/440.2, 297/440.1, 44.21, 440.23; 5/12.2; 403/360, 403/381

See application file for complete search history.

(56) References Cited

U.S. PATENT DOCUMENTS 3,663,059 A * 5/1972 Omlie ..... 297/440.2
4,140,065 A * 2/1979 Chacon ..... 108/156
5,000,512 A * 3/1991 Laird ..... 297/440.1
5,080,438 A * 1/1992 Moyer ..... 297/440.23
5,332,289 A * 7/1994 Nottingham et al. .... 297/440.1
5,738,414 A * 4/1998 Wieland et al. ..... 297/440.1
6,241,317 B1 * 6/2001 Wu ..... 297/440.23
6,367,880 B1 * 4/2002 Niederman et al. .... 297/440.14
6,595,592 B1 * 7/2003 Wieland et al. ..... 297/440.23
6,942,298 B2 * 9/2005 Harrison ..... 297/440.1
7,020,911 B2 * 4/2006 Oldham ..... 5/12.2

* cited by examiner

*Primary Examiner*—David Dunn
*Assistant Examiner*—Erika Garrett
(74) *Attorney, Agent, or Firm*—Morland C. Fischer

(57) ABSTRACT

A break-down sofa having a frame that is adapted to be disassembled to facilitate transport and storage in a substantially flat shipping configuration. The frame of the sofa includes a seat platform to support the weight of a user, a front panel detachably connected to the front of the seat platform, opposing side panels detachably connected to opposite sides of the seat platform, and a back panel detachably connected to the back of the seat platform. To better enable the back panel to withstand a rearward pushing force applied thereagainst by a user who is seated upon the seat platform, complementary male and female interlocking members are moved into mating engagement with one another to hold the back panel in place between the opposing side panels. The male interlocking member includes a post affixed to and projecting from each side wall of the back panel, and the female interlocking member includes a keyway affixed to the opposing side panels to removably receive therewithin and capture respective ones of the posts.

3 Claims, 6 Drawing Sheets

BREAK-DOWN SOFA HAVING A DETACHABLE FRAME

BACKGROUND OF THE INVENTION

1. Field of the Invention

This invention relates to a break-down sofa having a frame that is adapted to be disassembled to facilitate transport and storage in a substantially flat shipping configuration. The sofa frame may be easily reassembled by the purchaser for use at its final destination.

2. Background Art

Large pieces of furniture, such as chairs, sofas, and the like, are typically shipped from a location of manufacture to a location of distribution to a location of sale to the public. The large and bulky natures of these articles contribute to the purchase price paid by consumers. That is to say, as a consequence of their space-consuming size, relatively large shipping vessels are required to move the furniture from place-to-place. Moreover, relatively large storage facilities are necessary to accommodate the furniture while in transit from location-to-location. Unlike smaller articles that are capable of being transported and stored in compact shipping containers, larger pieces of furniture are often not suitable to be palatized. In addition, more than one workman may be necessary to handle the loading and transport of the furniture from its initial point of manufacture to its final point of sale. In this same regard, purchasers may not be able to easily lift and carry their furniture from the location of purchase to the location of use.

Accordingly, what would be desirable is a means to enable typically large and bulky articles of furniture to be shipped, stored and carried home in one or more space-efficient and generally flat shipping containers that are adapted to be palatized, handled by a limited number of workmen while in route, and easily moved by the purchaser, whereby to reduce the cost and inconvenience normally associated with transport of the furniture from manufacture to use.

SUMMARY OF THE INVENTION

In general terms, a break-down sofa is disclosed having a frame that is capable of being easily disassembled so as to be moved from place-to-place in one or more space-efficient and generally flat shipping containers that facilitate transport and storage. The frame of the break-down sofa includes a seat platform and a front panel, a back panel, and a pair of opposing side panels that are all detachably connected to the seat panel by means of suitable fasteners (e.g., bolts). The usual seat cushions can be laid upon the seat platform, and backrests can be placed against the back panel of the assembled frame to ready the sofa for use.

To help prevent the backrest from tilting away and being unintentionally separated from the seat panel in response to a rearward pushing force generated by users, a supplemental attachment means is connected therebetween. The supplemental attachment means includes a restraint affixed to each of the side walls of the back panel of the frame and a complementary receptacle affixed to each of the opposing side panels. In the assembled sofa configuration, a restraint is moved into face-to-face mating engagement with a receptacle to hold the back panel in place between the opposing side panels.

Each restraint of the supplemental attachment means has a support plate secured to a side wall of the back panel. A stud projects outwardly from one end of the support plate, and a male post projects outwardly from the opposite end. A relatively wide head is carried by the male post. The complementary receptacle of the supplemental attachment means has a base plate secured to each of the opposing side panels. A female keyway runs longitudinally along the base plate, and a relatively wide keyhole is formed at one end of the keyway.

Initially, the back panel is held above the opposing side panels. As the back panel is lowered towards the side panels to complete the assembly of the frame for the sofa, the heads carried by the male posts of the restraints are received in respective keyholes of the female keyways of the receptacles. Both the stud and the post of a restraint will ride through the keyway of a receptacle until the head that is carried by the post is seated at one end of and captured by the keyway to hold the restraint and receptacle together. Each restraint and its complementary receptacle cooperate with one another in the supplemental attachment means to resist tilting of the back panel away from the opposing side panels between which the back panel is held. What is more, the studs which project from the support plates of the restraints prevent the back panel from wobbling back and forth after the frame of the break-down sofa has been fully assembled.

DESCRIPTION OF THE PREFERRED EMBODIMENT

Figure 1:
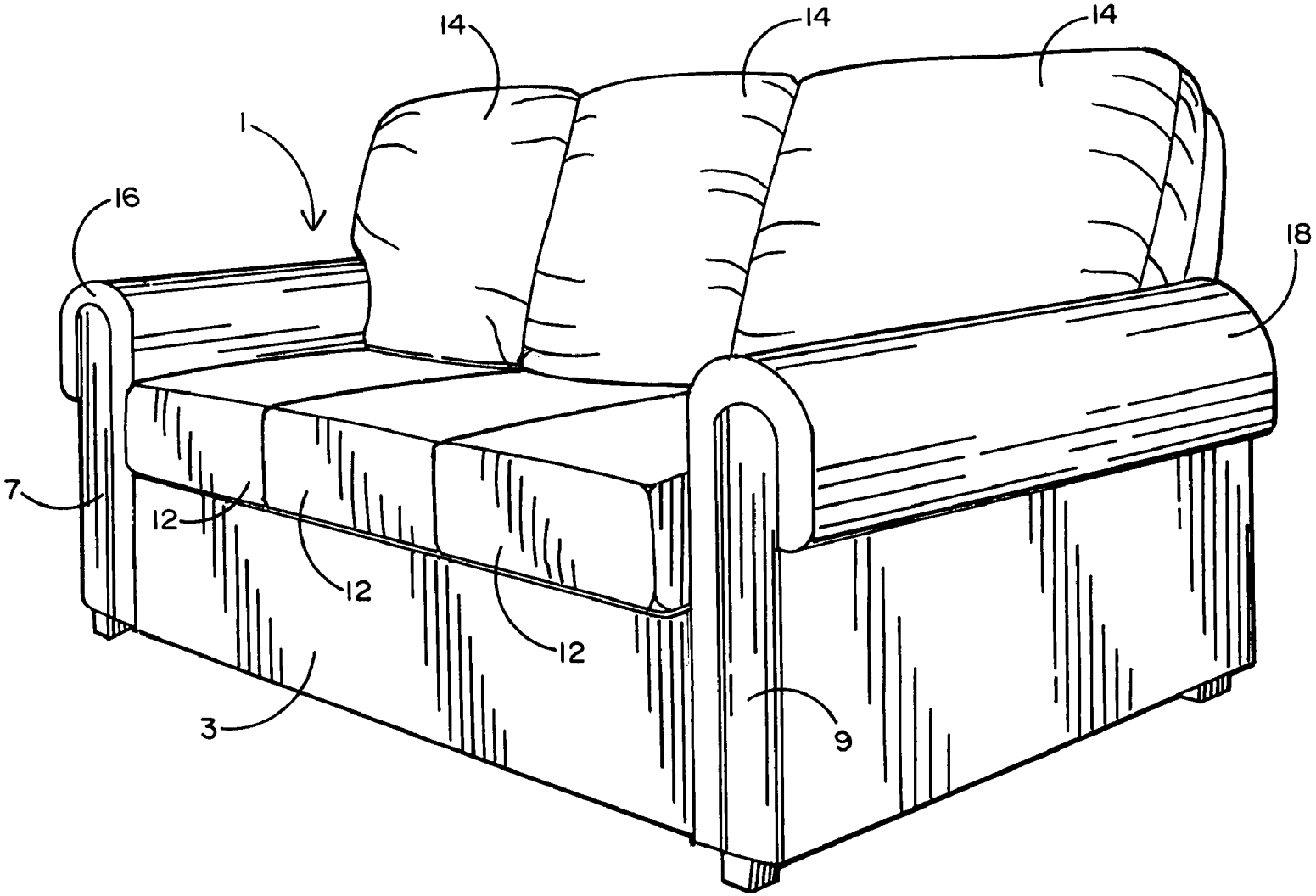
FIG. 1 shows one example of a break-down sofa according to the present invention having a detachable frame in a fully assembled, ready to use configuration.
Figure 2:
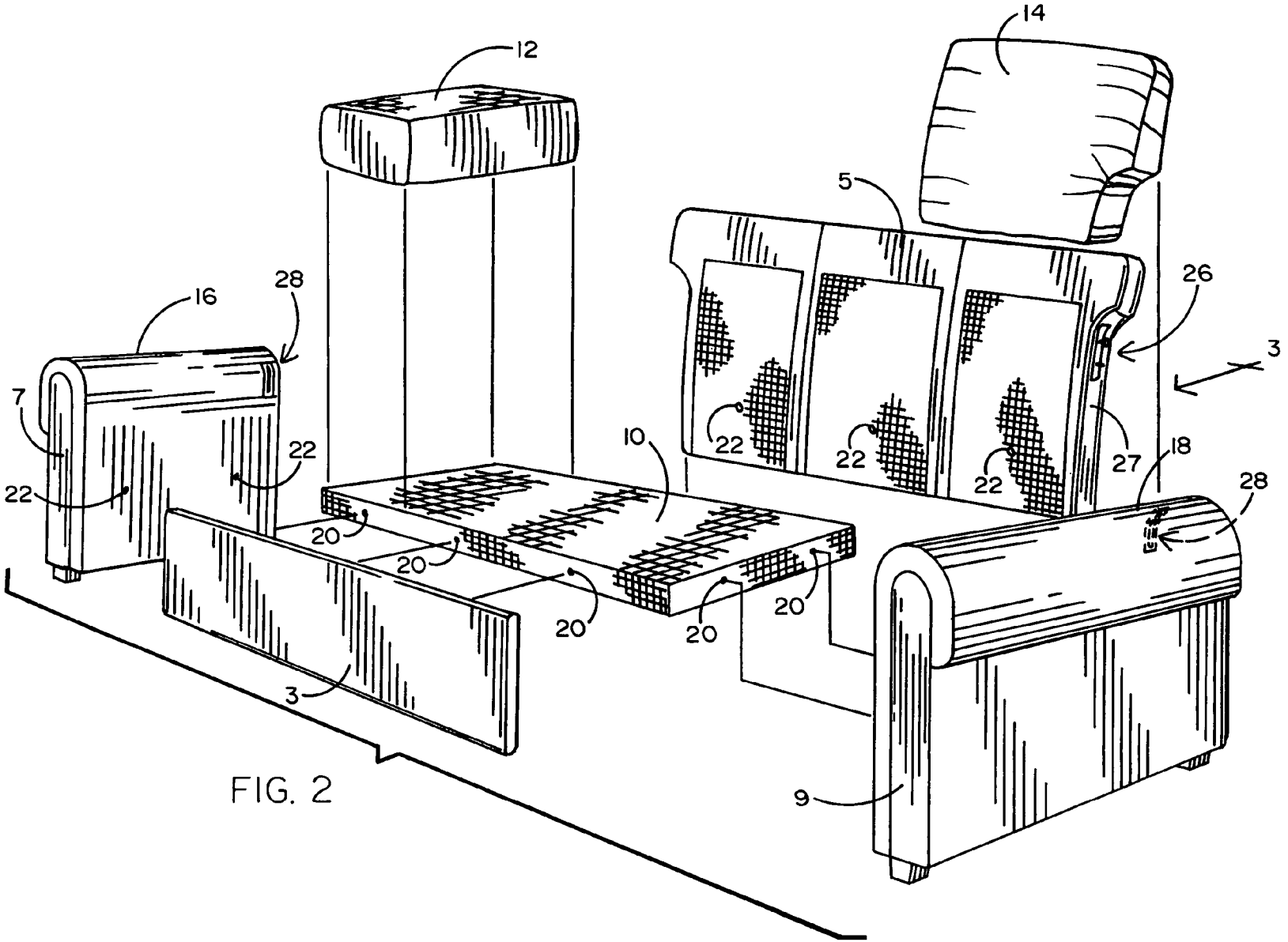
FIG. 2 shows the detachable frame of the break-down sofa of FIG. 1 in a disassembled configuration.

A preferred embodiment of the break-down sofa 1 which forms the present invention is described while referring to FIGS. 1 and 2 of the drawings. As will be described in greater detail hereinafter, the sofa 1 includes a frame that is adapted to be disassembled to facilitate shipment and storage in a relatively flat configuration. By virtue of the foregoing, manufacturers and consumers will be able to conveniently ship and easily carry the sofa 1 in its disassembled condition from the point of manufacture to the point of use where the frame of the sofa is removed from its shipping containers and reassembled.

The frame of the break-down sofa 1 includes a front panel 3, a back panel 5, opposing side panels 7 and 9, and a seat platform 10. A set of seat cushions 12 are laid upon the seat platform 10 and a (e.g., matching) set of back rests 14 are laid against the back panel 5. The opposing side panels 7 and 9 may be covered with padded arm rests 16 to enhance the comfort of the user. In this same regard, the front and back panels 3 and 5 may be upholstered to improve the aesthetic appearance of the sofa 1.

Figure 3:
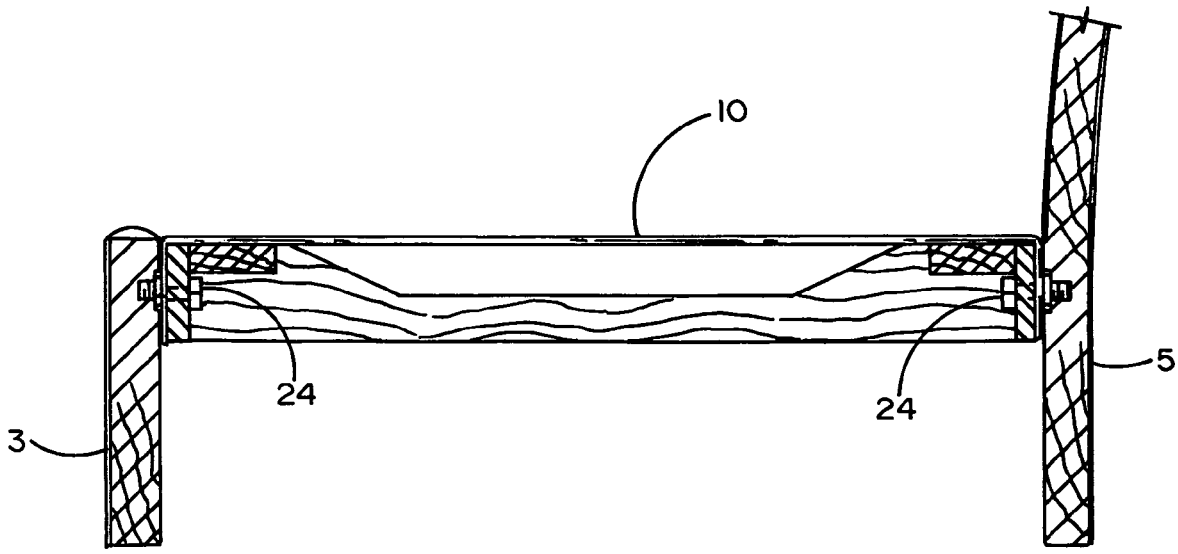
FIG. 3 shows front and back panels attached to a seat platform of the detachable frame of the break-down sofa.

To enable the frame of the break-down sofa 1 to be quickly and easily disassembled for shipment and reassembled following delivery, the seat platform 10 is provided with a plurality of bolt holes 20 that are formed through the front, back and side walls thereof (best shown in FIG. 2). The bolt holes 20 through seat platform 10 are axially aligned with corresponding threaded holes 22 that are formed in the front panel 3, the back panel 5, and the opposing side panels 7 and 9. Respective bolts 24 (best illustrated in FIG. 3) are inserted through pairs of axially aligned holes 20 and 22 for the purpose of detachably connecting the seat platform 10 to each of the front panel 3, the back panel 5, and the opposing side panels 7 and 9 of the sofa frame. As is also best shown in FIG. 3, the bolts 24 are inserted at the underside of the seat platform 10.

During normal use, the relatively tall back panel 5 of the sofa 1 will be subjected to pushing forces as users lean rearwardly thereagainst. In some cases, the bolts 24 which interconnect the back panel 5 to the seat platform 10 may not be sufficient to prevent the back panel 5 from possibly tilting away and separating from the seat platform 10. Accordingly, and in accordance with an important aspect of this invention, a supplemental attachment means is provided to hold the back panel 5 in place between the opposing side panels 7 and 9 of sofa 1. More particularly, the supplemental attachment means includes a pair of restraints 26 that are mounted on the back panel 5. One of such restraints 26 is located at each side wall 27 of the back panel 5 so as to cooperate with a complementary receptacle 28 that is mounted on each of the opposing side panels 7 and 9.

Figure 4:
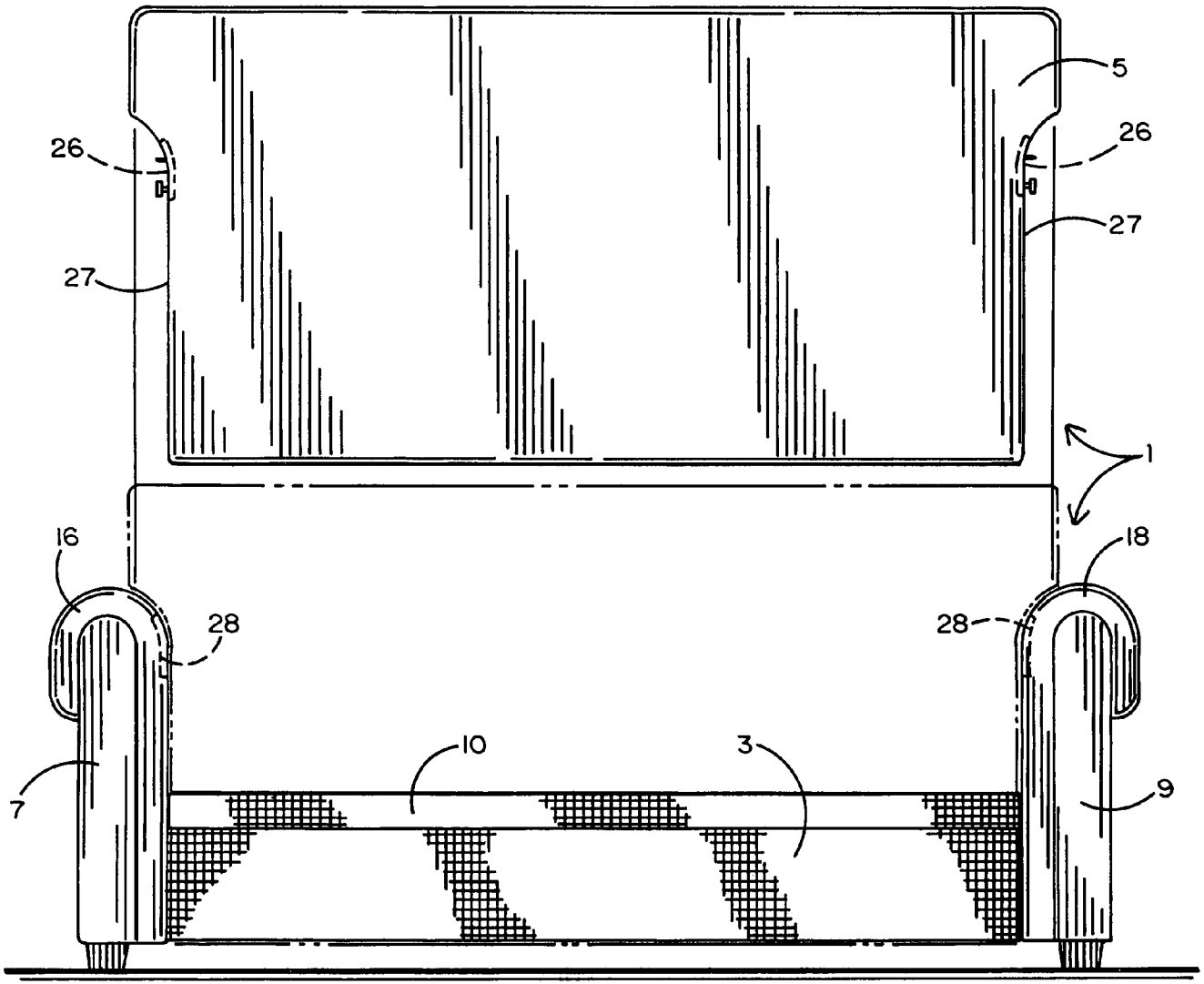
FIG. 4 illustrates the back panel lifted above the frame of the break-down sofa prior to assembly.

Referring to FIG. 4 of the drawings, in order to complete the detachable frame of break-down sofa 1, the back panel 5 is initially lifted above the opposing side panels 5 and 7 and the seat platform 10. The back panel 5 is then lowered towards the seat platform 10 until the restraints 26 at opposite side walls 27 of back panel 5 slide into mating engagement with the complementary receptacles 28 at the opposing side panels 7 and 9. With the restraints 26 received by respective receptacles 28 of the supplemental attachment means, a an additional attachment is established to withstand the rearward pushing force to which the back panel 5 will be subjected when the sofa 1 is in use. That is, both the bolts 24 (of FIG. 3) and the cooperation between restraints 26 and receptacles 28 act to reliably hold the back panel 5 in place between the opposing side panels 7 and 9.

Figure 5:
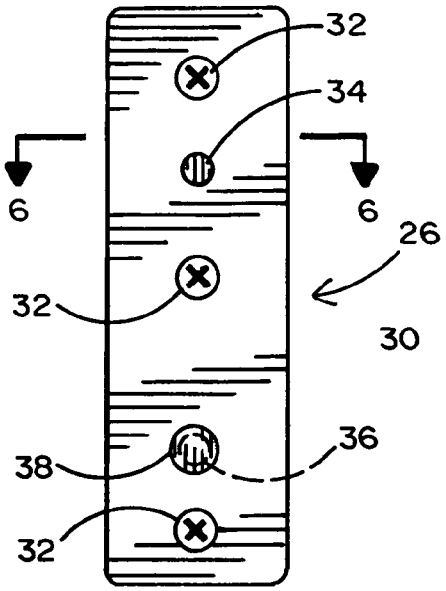
FIGS. 5 and 6 show a restraint to be affixed to each side wall of the back panel of the break-down sofa.
Figure 6:
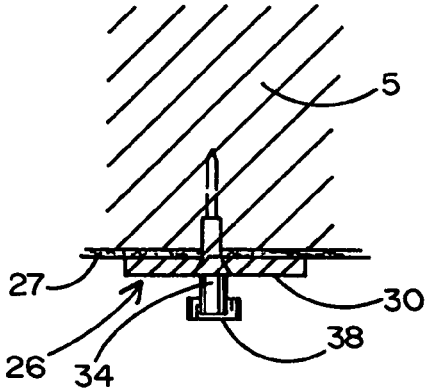

Details of the aforementioned supplemental attachment means including the restraints 26 mounted on back panel 5 and the receptacles 28 mounted on the opposing side panels 7 and 9 and the mating engagement therebetween to hold the back panel 5 between side panels 7 and 9 and to prevent the back panel 5 from being pushed away and unintentionally separated from the seat platform 10 are now described while referring to FIGS. 5-8 of the drawings. As is best shown in FIGS. 5 and 6, each restraint 26 includes a support plate 30 that is affixed to one side wall 27 of the back panel 5 by means of a plurality of (e.g., three) fasteners (e.g., screws) 32. The support plate 30 may have any suitable contour, such as the curved shape shown in FIGS. 9 and 10, which conforms to the shape of the side wall 27 to which the support plate 30 will be secured.

Projecting outwardly from the top of the support plate 30 of the restraint 26 is a cylindrical stud 34. The stud may be welded to the support plate 30. Projecting outwardly from the bottom of the support plate 30 is a threaded post 36. One end of the threaded post is affixed (e.g., screwed) to the support plate 30. Post 36 may also be welded to the support plate 30. A relatively wide head 38 is located at the opposite end of the threaded post 36 for receiving a rotational force in order to attach the post 36 to the support plate 30.

Figure 7:
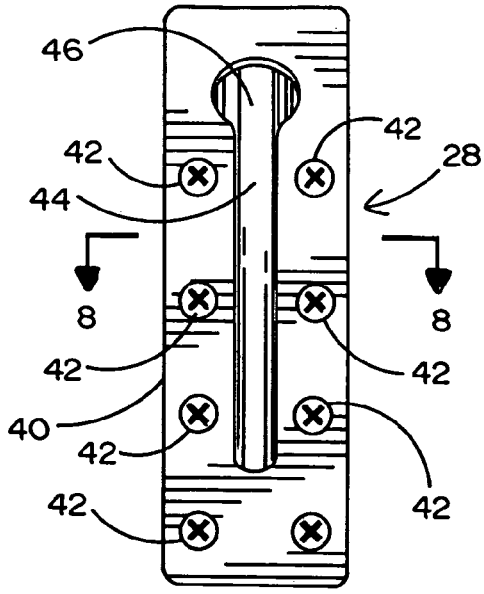
FIGS. 7 and 8 show a complementary receptacle to be affixed to each of the opposing side panels of the break-down sofa to be mated to a respective restraint of FIGS. 5 and 6.
Figure 8:
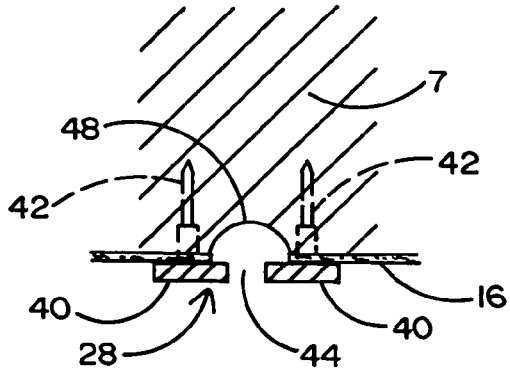

As is best shown in FIGS. 7 and 8, the complementary receptacle 28 of the supplemental attachment means includes a base plate 40 that is affixed to one side panel (e.g., 7) through the cushioned arm rest 16 thereof by means of (e.g., two rows of) fasteners (e.g., screws) 42. In the assembled sofa relationship of FIGS. 1 and 2, the base plate 40 of receptacle 28 will lie flush against the side panel 7 and opposite the support plate 30 of the restraint 26 that is affixed to one side wall 27 of the back panel 5. Moreover, the base plate 40 of receptacle 28 that is affixed to the other side panel 9 will lie flush against side panel 9 and opposite the support plate 30 of the restraint 26 that is affixed to the opposite side wall of the back panel 5. Like the support plate 30 of restraint 26, the base plate 40 of receptacle 28 may have any suitable (e.g., curved) contour, such as that shown in FIGS. 9 and 10, which conforms to the shape of the side panel 7 to which the base plate 40 will be affixed.

Running longitudinally along the base plate 40 of the receptacle 28 is a female keyway 44. Located at one end of the keyway 44 is a relatively wide keyhole 46. The keyhole 46 is sized to accommodate therewithin the head 38 of the male post 36 which projects from the support plate 30 of restraint 26. The keyway 44 is sized to accommodate both the stud 34 and the post 36 which project from support plate 30 in order to hold the back panel 5 between the opposing side panels 7 and 9 and thereby complete the frame assembly of the break-down sofa 1. In the assembled relationship, the keyway 44 and the keyhole 46 of the base plate 40 of receptacle 28 lie directly over an elongated channel 48 that is formed through each arm rest (e.g., 16) and side panel (e.g., 7).

Figure 9:
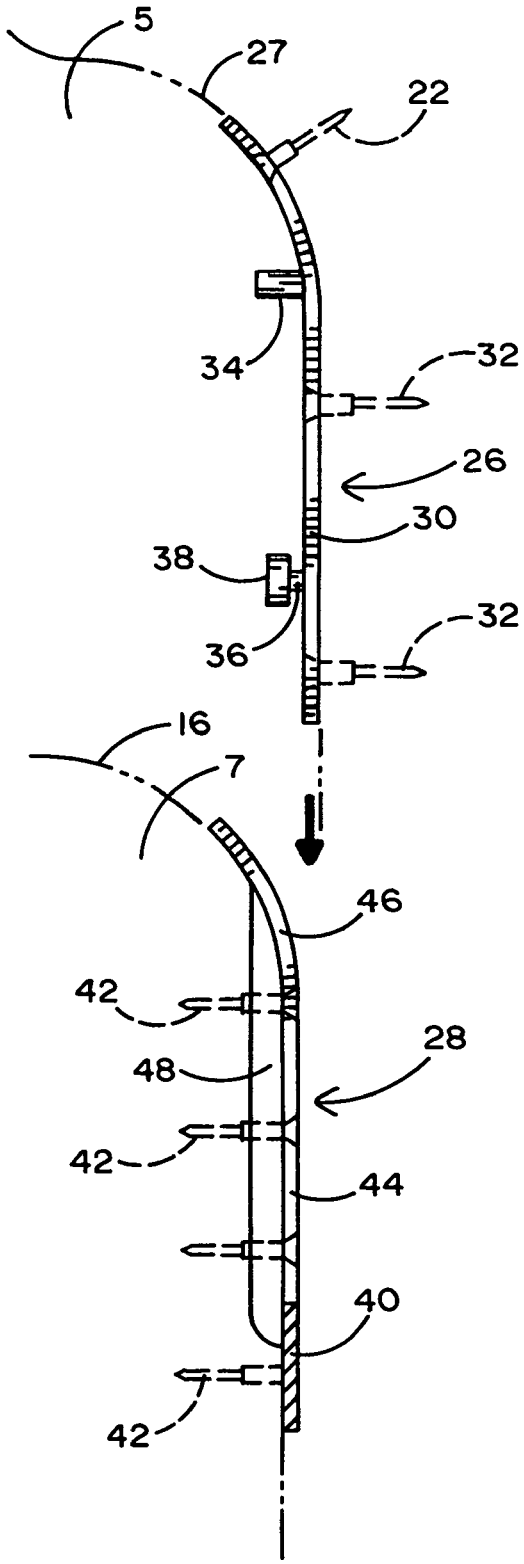
FIGS. 9 and 10 show the face-to-face mating engagement of a restraint at one side wall of the back panel to a complementary receptacle at one side panel, whereby to prevent the back panel from tilting away and separating from the opposing side panels during use of the break-down sofa.
Figure 10:
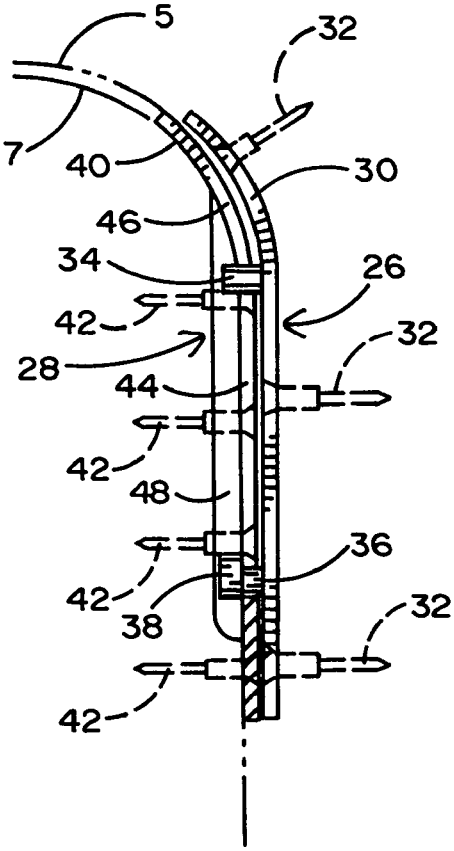

Turning to FIGS. 9 and 10 of the drawings, the mating engagement is shown between one restraint 26 that is mounted on one of the side walls 27 of the back panel 5 to a complementary receptacle 28 that is mounted on one of the opposing side panels 7 of the frame of sofa 1. As earlier explained, to complete the assembly of the frame of sofa 1, the back panel 5 is initially lifted above the opposing side panels, only one of which (designated 7) being shown in FIGS. 9 and 10. The back panel 5 is positioned relative to the side panel 7 so that the head 38 of the male post 36 which projects from the support plate 30 of restraint 26 is aligned for receipt by the keyhole 46 of the female keyway 44 which runs along the base plate 40 of receptacle 28.

As the back panel 5 is lowered towards the opposing side panels (e.g., 7) of the sofa 1, the relatively wide head 38 of the male post 36 is correspondingly moved through the keyhole 46 of the female keyway 44. The post 36 will now ride longitudinally through the keyway 44 until the head 38 of post 36 is seated at the bottom of the keyway 44 (best shown in FIG. 10). At the same time that the post 36 is riding through the keyway 44, the stud 34 which also projects from the support plate 30 of restraint 26 will enter the keyhole 46 and ride through keyway 44. The head 38 of post 36 and the stud 34 will also be received in and slide through the channel 48 that is formed within the side panel 7. By virtue of the channel 48 in which to receive the head 38 and the stud 34, the base plate 40 of receptacle 28 can be held flush against the side panel 7. The stud 34 acts to stabilize the ride of the male post 36 through the female keyway 44 and the channel

48. In addition, the receipt of the stud 34 within keyway 44 and channel 48 prevents the back panel 5 from wobbling back and forth after its attachment between the opposing side panels 7 and 9 of the sofa 1.

With the relatively wide head 38 of the male post 36 of the restraint 26 of the supplemental attachment means seated at the bottom of and captured by the female keyway 44 of the receptacle 28, a complementary restraint and receptacle pair are mated together in face-to-face alignment (best shown in FIG. 10). Accordingly, the back panel 5 will now be detachably connected to the seat platform 10 (best shown in FIG. 1) and held between the opposing side panels 7 and 9 of the break-down sofa 1 so that the various seat cushions and back rests (designated 12 and 14 in FIGS. 1 and 2) may be added to ready the sofa for use. Of course, should it be necessary to disassemble the frame of the sofa 1 for additional shipment or storage, the back panel 5 may be easily separated from the opposing side panels 7 and 9 by simply reversing the assembly steps that have just been disclosed above.

Although the improvement of this invention has been described with regard to a break-down sofa, it is to be expressly understood that this same improvement is also applicable to other seating articles (e.g., chairs, and the like) which have a detachable back panel.

I claim:

1. A break-down seating article, comprising:

a seat platform having a front, a back, and opposite sides and being adapted to support the weight of a user;

opposing side panels detachably connected to the opposite sides of said seat platform;

a back panel detachably connected to the back of said seat platform, said back panel having first and second side walls;

fastener means to detachably connect said back panel to said seat platform; and supplemental attachment means to detachably connect the first and second side walls of said back panel to respective ones of said opposing side panels, said supplemental attachment means including a post and a stud disposed in axial alignment one above the other and carried by each of the first and second side walls of said back panel and a keyway carried by each of said opposing side panels, each post having a relatively wide head and each keyway having a correspondingly wide keyhole located at one end thereof and being sized to accommodate the relatively wide head of said post therethrough, the posts and the studs at the first and second side walls of said back panel moving inwardly through the keyholes of the keyways at respective ones of said side panels and riding with one another through said keyways, each keyway having a narrow size relative to said keyhole thereof to prevent a removal of the wide head of said post from said keyway after said post rides therethrough, said studs being received by said keyways to prevent said back panel from wobbling back and forth with respect to said opposing side panels to which said back panel is detachably connected.

2. The break-down seating article recited in claim 1, further comprising removable fasteners by which said opposing side panels are detachably connected to the opposite sides of said seat platform and said back panel is detachably connected to the back of said seat platform.

3. The break-down seating article recited in claim 1, wherein said supplemental attachment means also includes a support plate secured to each of the first and second side walls of the back panel, said posts and said studs projecting from said support plates for receipt by respective ones of said keyways carried by each of said opposing side panels.

* * * * *